US005421648A

United States Patent [19]

Grabher

[11] Patent Number: 5,421,648

[45] Date of Patent: Jun. 6, 1995

[54] DRAWER GUIDE

[75] Inventor: Guenter Grabher, Fussach, Austria

[73] Assignee: GRASS AG, Hochst/VLBG., Austria

[21] Appl. No.: 102,648

[22] Filed: Aug. 5, 1993

[30] Foreign Application Priority Data

Aug. 13, 1992 [DE] Germany ..... 42 26 812.5

[51] Int. Cl.[6] ..... A47B 88/08

[52] U.S. Cl. ..... 312/331; 312/334.13

[58] Field of Search ..... 312/334.9, 334.8, 334.11, 312/331, 334.13, 334.1

[56] References Cited

U.S. PATENT DOCUMENTS 3,545,833 12/1970 Stein et al. ..... 312/334. 9
3,687,505 8/1972 Fall ..... 312/331
5,275,064 1/1994 Hobbs ..... 312/331

FOREIGN PATENT DOCUMENTS 1966323 8/1967 Germany .

*Primary Examiner*—Kenneth J. Dorner
*Assistant Examiner*—Gerald A. Anderson

[57] ABSTRACT

A drawer guide including a drawer rail for connection to a drawer, a carcass rail for connection to a carcass and a center rail which engages the drawer and carcass rails in a load transmitting relationship. Engagement with the drawer and carcass rails is by means of upper and lower carriages each of which include a plurality of rollers. In order to obtain synchronous displacement of the center rail during displacement of the drawer rail, there is provided a closed loop cable or chain traction means which runs over guide rollers arranged on opposite ends of the center rail. The upper run of the traction means is connected to both ends of the upper carriage, while the lower run of the traction means is connected to both ends of the lower carriage.

8 Claims, 3 Drawing Sheets

DRAWER GUIDE

TECHNICAL FIELD

The present invention relates to drawer guides of the typed used to support a drawer in a cabinet body.

BACKGROUND ART

Such guides typically include a cabinet body rail for connection to a cabinet body, a drawer rail for connection to a drawer, a center rail and carriages with rolling means acting between the rails. The design of such guides is intended to ensure that when the drawer is pulled out of the cabinet body, the center rail is entrained in order to ensure maximum possible support of the drawer. This is referred to as differential withdrawal. It is important here to synchronize the withdrawal movement of the drawer with the withdrawal movement of the center rail in order to accomplish the required differential withdrawal. This may be achieved by means of a closed traction means such as a cable or chain which runs over guide rollers located at front and rear ends of the center rail.

A drawer guide of the kind mentioned above is described in German Utility Model 1 966 323.

There is also known a drawer guide in which there are upper and lower carriage assemblies, wherein in a cabinet body rail a lower carriage cooperates with a center rail and an upper carriage cooperates with a guide rail on the drawer side. The traction means is however different from that in German utility model 1966323, particularly on account of the fact that a total of four carriage assemblies rolling over different tracks are needed and the ends of the traction means are connected to the cabinet body rail and drawer rail.

OBJECTS OF THE INVENTION

It is therefore an object of the invention to provide a drawer guide of the kind mentioned above which provides with substantially lower production costs, a simpler arrangement which operates more reliably.

Another object of the invention is to provide a drawer guide in which differential withdrawal is reliably achieved.

A further object of the invention is to provide a drawer guide in which the traction means does not need to be directly connected to the cabinet body rail or drawer rail.

SUMMARY OF THE INVENTION

The foregoing objects are met in accordance with the present invention by the provision of a drawer guide for supporting one side of a drawer with respect to a cabinet body including a cabinet body rail for connection to a carcass, a drawer rails for connection to a drawer, a center rail, first and second carriages both with rolling means acting between the rails, a guide roller at opposite end regions of the center rail, a closed traction means with an upper run and a lower run, wherein said first carriage is arranged in load-transmitting relationship between said drawer rail and said center rail and said second carriage is arranged in load-transmitting relationship between said cabinet body rail and said center rail and wherein said traction means runs over said guide rollers and each of said runs of traction means is connected to a different one of said carriages at each of said carriage's ends so as to synchronize displacement of said center rail as said drawer rail is displaced relative to said carcass rail.

An essential characteristic of the invention is that the guide rollers over which the traction means is guided are arranged at the front and rear ends of the center rail and that the traction means is attached to upper and lower carriages at mutually opposed ends of the carriage.

With this arrangement, there is provided the essential advantage that when the drawer is pulled out of the cabinet body, the center rail is now entrained precisely by half the distance of withdrawal with synchronous movement, wherein gentle withdrawal of the drawer from the cabinet body is ensured and at the same time the drawer is also fully supported in its withdrawn position by the carriage assembly on the center rail.

It is preferred if the rolling means includes several rolling bodies such as rollers and the rollers are arranged one above the other and form corresponding running planes for engagement of the center rail which is entrained between the carriage assemblies, each carriage being carried by these rollers. Lateral guiding rollers may also be provided for maintaining the distance between the carriages or between the carriages and the rails, in order to ensure lateral guiding of the rail assembly. This lateral guiding may alternatively be provided by the rolling means.

A wire cable is preferably used as the traction means, but other traction means can be used instead, e.g. plastic cables and the like.

BRIEF DESCRIPTION OF THE DRAWING

The invention is described in more detail below with reference to the accompanying figures showing only one embodiment. Further characteristics essential to the invention and advantages of the invention are apparent from the figures and the description thereof. The figures show.

DETAILED DESCRIPTION

Drawer rails 2 are attached on each side to a drawer 1 which is connected to a frame 9. For simplicity's sake, in the description below only one drawer guide is described, because that located on the opposite side of the drawer is of exactly identical construction.

Figure 3:
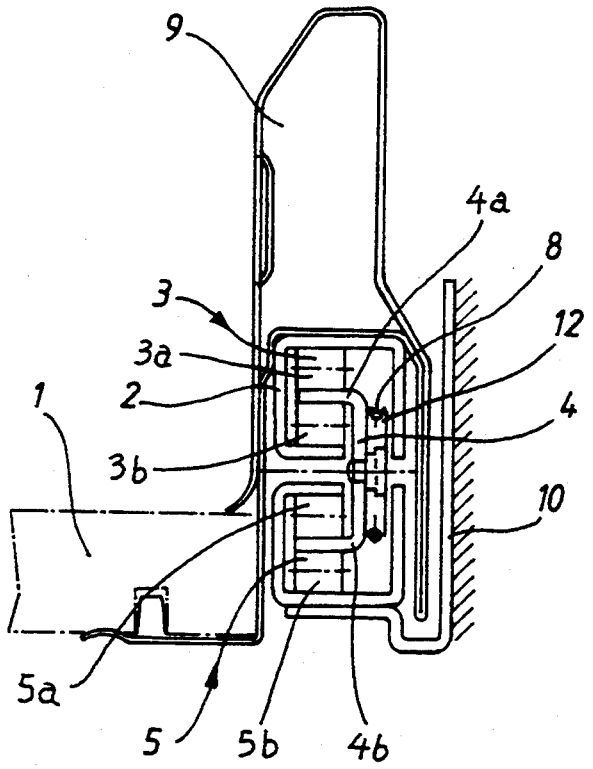
FIG. 3: section through the line III—III in FIG. 2.

The drawer rail 2 forms an approximately C-shaped profile in which is arranged an upper carriage 3. Only the upper and lower rollers of the carriage in FIG. 3 are shown, the carriage itself not being shown for simplicity's sake. The rollers are rotatable in a manner known in the art or held freely guided in a corresponding carriage body.

The center rail 4 constructed as a U-profile engages by a first bent arm 4*a* of the U between the upper 3*a* and lower 3*b* roller assemblies of the upper carriage 3.

The lower assembly of the drawer guide is similar to the upper assembly described above. On a cabinet body 14 a cabinet body rail 10 is arranged which is also approximately C-shaped. A lower carriage 5 with upper 5*a* and lower 5*b* roller assemblies rolls along in the cabinet body rail 10. A second bent arm 4*b* of the center rail 4 is rollingly and slidably engaged by the lower carriage roller assemblies 5*a* and 5*b*.

The center rail 4 is provided at its front and rear ends with a guide rollers 12 and 11 respectively which are mounted rotatably on the center rail. Over the guide rollers 11 and 12 is guided a traction means 8 which is connected by connection means 3*a* to the upper run 8*a* of the traction means at the front and rear ends of the upper carriage 3. The lower run 8*b* of the traction means 8 is connected by connection means 5*a* to the front and rear ends of the lower carriage 5.

This simple assembly operates reliably. When the drawer 1 is pulled out of a carcass in the direction of the arrow 6, the upper carriage 3 is smoothly and reliably entrained as far as the mid point of the drawer rail 2. Thus the drawer is optimally supported via the carriage 3 and the center rail 4 on the cabinet body rail 10.

At the same time the center rail 4 is supported relative to the cabinet body rail 10 via the carriage 5 which runs into the rear portion of the center rail 4.

Figure 1:
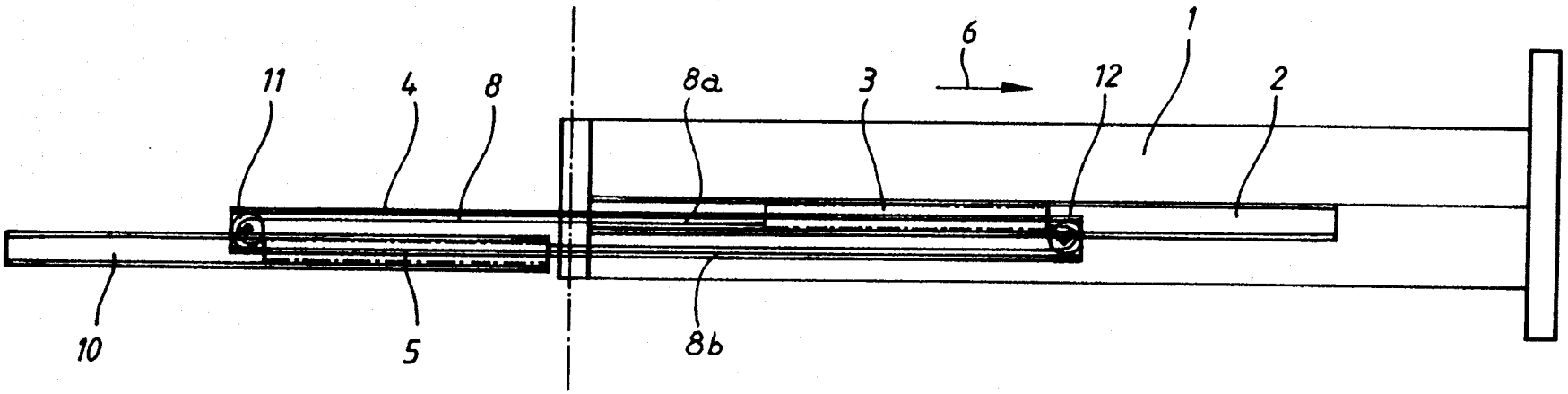
FIG. 1: a schematic section through a drawer guide according to the invention in the pulled-out state.
Figure 2:
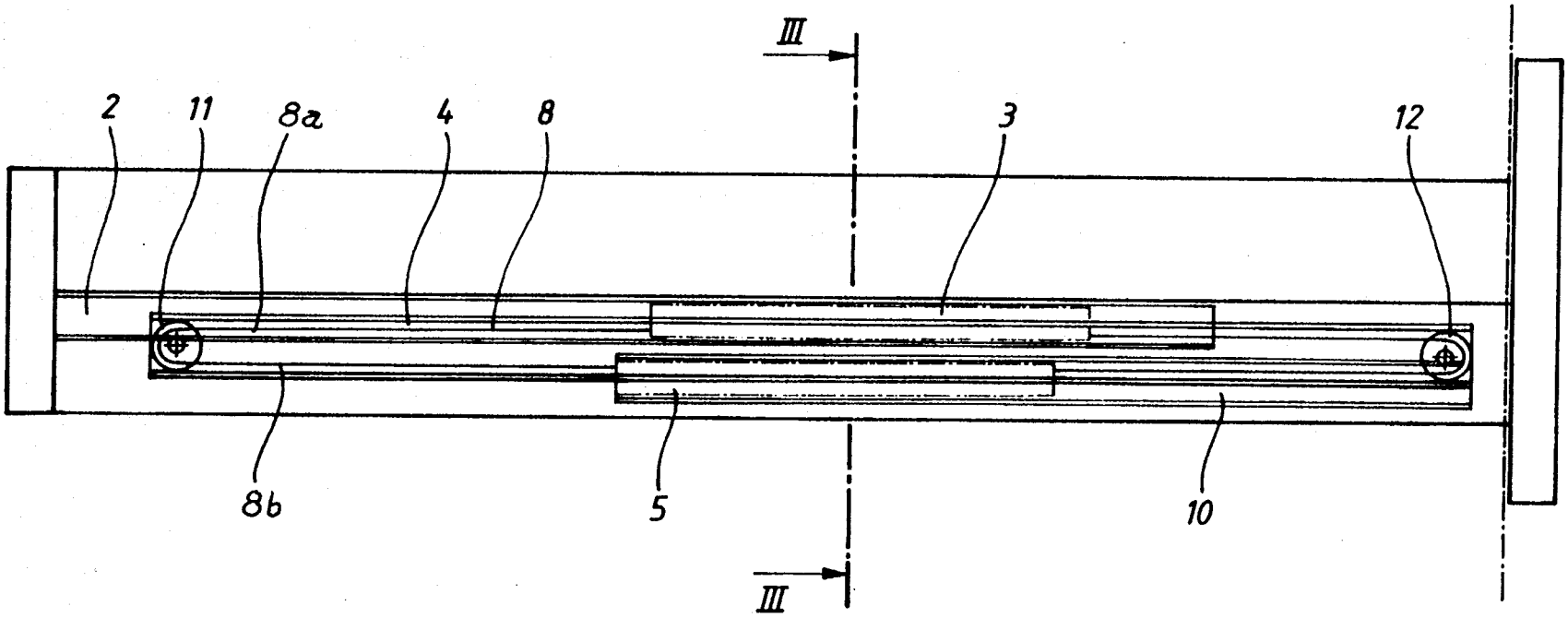
FIG. 2: the same view as FIG. 1 in the pushed-in state.

In the pushed-in state (FIG. 2), the two carriages 3, 5 are located approximately one above the other.

With this description of the invention in detail those skilled in the art will appreciate that modifications may be made to the invention without departing from the spirit thereof. Therefore it is not intended that the scope of the invention be limited to the specific embodiments. Rather it is intended that the scope of the invention be determined by the scope of the appended claims. The invention should be considered as extending to any novel combination of claims or features disclosed in the specification or abstract.

I claim:

1. A drawer guide for supporting one side of a drawer with respect to a cabinet body, comprising:

a cabinet body rail for connection to the cabinet body;

a drawer rail for connection to the drawer;

a center rail having opposite end regions;

first and second carriages both with rolling means acting between the rails;

a plurality of guide rollers disposed at opposite end regions of the center rail;

a closed traction means with an upper run and a lower run;

wherein said first carriage is arranged in a load-transmitting relationship between said drawer rail and said center rail, and said second carriage is arranged in a load-transmitting relationship between said cabinet body rail and said center rail;

and wherein said traction means runs over said guide rollers and each of said runs of traction means is connected to a different one of said carriages at each of said carriage's ends so as to synchronize displacement of said center rail as said drawer rail is displaced relative to said cabinet body rail.

2. A drawer guide as claimed in claim 1 wherein when said drawer guide is fully extended said first carriage is displaced substantially half the length of the drawer rail.

3. A drawer guide as claimed in claim 1 wherein said closed traction means is a cable.

4. A drawer guide as claimed in claim 1 wherein the closed traction means is a chain.

5. A drawer guide as claimed in claim 1 wherein said first and second carriages are connected to said upper and lower runs of traction means respectively.

6. A drawer guide as claimed in claim 1 wherein each said rolling means includes several rolling bodies.

7. A drawer guide as claimed in claim 6 wherein said rolling bodies are rollers.

8. A drawer supported on both sides in a carcass with a drawer guide as claimed in claim 1.

* * * * *